United States Patent [19]

Collins

[11] 4,360,490

[45] Nov. 23, 1982

[54] STUDS FOR FOOTWEAR AND METHOD OF MAKING SAME

[75] Inventor: Roy S. Collins, Sutton Coldfield, England

[73] Assignee: Triman Limited, Tamworth, England

[21] Appl. No.: 66,879

[22] Filed: Aug. 16, 1979

[30] Foreign Application Priority Data

Aug. 16, 1978 [GB] United Kingdom ..... 33483/78

[51] Int. Cl.[3] ..... B29C 19/00

[52] U.S. Cl. ..... 264/249; 36/59 B; 264/242

[58] Field of Search ..... 264/242, 244, 249; 36/59 B, 67 D

[56] References Cited

U.S. PATENT DOCUMENTS 3,715,817 2/1973 White et al. ..... 36/67 D
3,977,097 8/1976 Ueda ..... 36/67 D

FOREIGN PATENT DOCUMENTS 2607402 8/1977 Fed. Rep. of Germany .
1033338 6/1966 United Kingdom .

*Primary Examiner*—Donald E. Czaja
*Assistant Examiner*—W. Thompson
*Attorney, Agent, or Firm*—Scrivener, Clarke, Scrivener and Johnson

[57] ABSTRACT

A stud for releasable attachment to an article of footwear, particularly for use in games and sports, comprises a support made of plastics material such as glass-filled nylon and a metal pin element. The support has an externally screw-threaded sleeve for engagement with a socket in an article of footwear and an outwardly directed flange for engagement with the lower end of the socket or with the sole of the article of footwear. The pin element comprises a stem and a ground-engaging head which may be blunt or spike-shaped. In assembly the stem is inserted into the sleeve and is then deformed as by riveting to secure the support and the pin element together.

9 Claims, 8 Drawing Figures

STUDS FOR FOOTWEAR AND METHOD OF MAKING SAME

Figure 1:
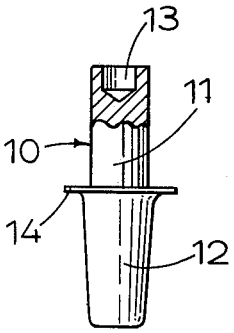

This invention relates to studs for footwear, and in particular to studs of the kind that can be removed and replaced at will.

Shoes and other articles of footwear for use in various games, sports and other athletic activities are often provided with studs to prevent or reduce the tendency for them to slip on the ground. The studs have ground-engaging heads of various shapes and sizes, some being blunt and others being in the shapes of spikes and being often referred to as spikes; studs embodying the present invention may have blunt heads or spike-shaped heads.

Various forms of removable and replaceable studs have been proposed, some of which have been in widespread use. One common form of stud is formed from metal as a unitary whole. A ground-engaging head has an outwardly directed flange at its upper end, and there is a screw-threaded spigot axially aligned with the head but on the other side of the flange from the head. In use the spigot is screwed into an internally screw-threaded socket incorporated in the sole of the article of footwear. One problem associated with that form of stud is that it tends to corrode with the result that the spigot tends to become so tightly locked in the socket that it can be removed only with difficulty and that its removal may damage the socket and render the article of footwear unusable. Another problem associated with that form of stud is that the forces applied to the socket through the stud when the stud is in use tend to be localised and undistributed so that there is danger that the socket of the sole of the article of footwear will become damaged relatively quickly. These and other difficulties can be avoided or at least reduced with the aid of the present invention.

From one aspect of the present invention consists in a method of making a stud for footwear, the stud comprising a support made of plastics material and a metal pin element, the support comprising an externally screw-threaded sleeve, for engagement with an internally screw-threaded socket in an article of footwear, and an outwardly directed flange for engagement with the lower end of the socket or with the underside of the article of footwear, and the pin element comprising a stem and a ground-engaging head, and the method comprising the steps of inserting the stem into the sleeve of the support and deforming the stem after insertion to secure the support and the pin element together.

The invention also consists in a stud for footwear made by the method outlined in the last preceding paragraph.

From another aspect the present invention consists in a stud for footwear comprising a support made of plastics material and a metal pin element, the support comprising an externally screw-threaded sleeve, for engagement with an internally screw-threaded socket in an article of footwear, and an outwardly directed flange for engagement with the lower end of the socket or with the underside of the article of footwear, and the pin element comprising a stem and a ground-engaging head, the stem having been deformed after insertion into the sleeve of the support to secure the support and the pin element together.

It is to be understood that the term plastics material as used herein includes within its scope synthetic plastics materials and natural plastics materials such as rubber, and also includes such materials incorporating fillers such as glass fibres.

Figure 2:
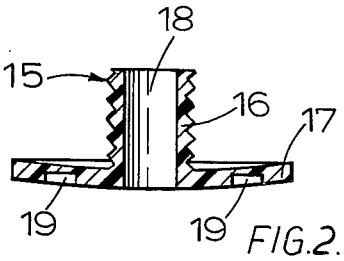
Figure 3:
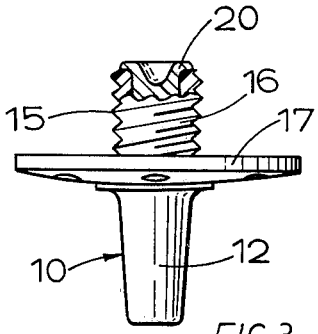
Figure 4:
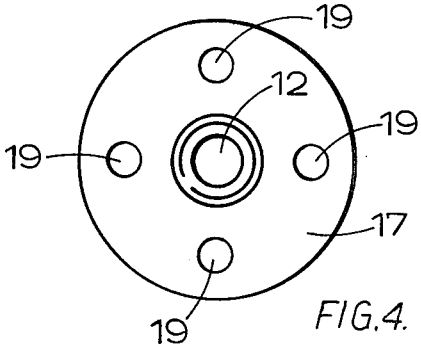
Figure 6:
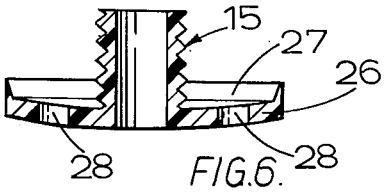
Figure 5:
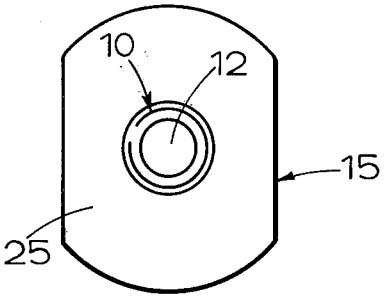
Figure 7:
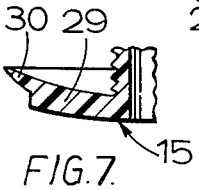
Figure 8:
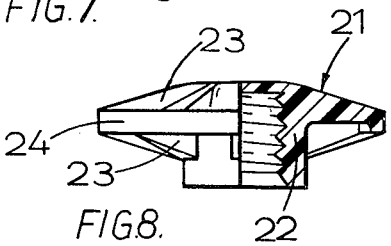

Embodiments of the invention will now be described in greater detail, by way of example, with reference to the accompanying drawings, in which:

FIG. 1 shows a metal pin element for incorporation in a stud embodying the present invention, the upper part being shown in section, FIG. 2 is a section through a support for use with a pin element of the kind shown in FIG. 1, FIG. 3 is a side view of a stud embodying the present invention and assembled from the pin element shown in FIG. 1 and the support shown in FIG. 2, FIG. 4 is an end view from below of the stud shown in FIG. 3, FIG. 5 is similar to FIG. 4 but illustrates a modified form of support, FIG. 6 is similar to FIG. 2 but illustrates another modified form of support, FIG. 7 is a scrap section, similar to part of FIG. 2 but illustrating yet another modified form of support, and FIG. 8 shows a socket for incorporation in the sole of an article of footwear and which can be used in conjunction with a stud of the kind shown in FIGS. 1 to 4 or a stud of that kind embodying any of the modifications illustrated in FIGS. 6 to 8.

The pin element 10 shown in FIG. 1 is made of metal and comprises a cylindrical stem 11 with a head 12 at one end. An axial opening 13 is formed in the free end of the stem 11. The head 12 is intended to engage the ground when the stud is in use and is of generally frustoconical shape, the broader end nearer the stem 11 diverging smoothly to form a narrow flange 14 and the narrower end further from the stem being blunt as illustrated. The head could be of any other shape suitable for engaging the ground and could, for example, take the form of a sharp spike.

The pin element 10 may be made in any suitable manner but is preferably made from cylindrical stock, the head 12 being formed by an upsetting, raising or similar process which does not involve metal being machined from the stock. The process may be carried out with the aid of a machine of the kind used in the manufacture of rivets. The pin element may be made from a steel of the kind referred to in British Standard Specification 971:1950 as En.8. After being formed the pin is hardened and tempered and may be plated to resist rusting; it may for example be nickel-plated.

The support 15 shown in FIG. 2 is made as a unitary moulding from a plastics material such as nylon or glass-filled nylon, or an acetal resin. The support comprises a tubular sleeve 16 having at one end an outwardly directed flange 17 of circular outline. The sleeve 16 is externally screw-threaded for releasable engagement with a socket in an article of footwear as described in more detail below, and has an axial hole 18 of cylindrical shape equal in diameter to the cylindrical stem 11 of the pin element 10 shown in FIG. 1. The flange 17 is in the shape of a shallow dome, the sleeve 16 projecting from the concave side thereof. Four blind holes 19 are formed in the convex side of the flange 17, the holes being disposed symmetrically about the axis of the support. In a modified form of support (not illustrated) the flange is planar rather than domed in shape.

FIG. 3 shows a stud assembled from the pin element 10 and the support 15. During assembly of the stud the stem 11 is inserted through the hole 18 so that the narrow flange 14 of the head 12 abuts the central part of the flange 17 of the support 15. The projecting end portion of the stem, formed with the axial opening 13, is then riveted over as shown at 20 to form a securing flange, there remaining a hollow in the riveted end portion and constituted by the remaining part of the opening 13. The support 15 is thus retained on the stem between the flange 14 and the riveted end 20. In this way the stud is formed as a permanent assembly, the components of which are restrained against relative axial movement and preferably against relative rotational movement. In a modified construction (not illustrated) a washer, preferably of metal, is disposed on the stem 11 between the flange 14 and the flange 17. In another modification (not illustrated) the flange 17 is formed with a recess to receive at least part of the narrow flange 14.

The stud shown in FIG. 3, together with similar studs, is intended for use with an article of footwear having internally screw-threaded sockets for the studs moulded into or otherwise located in the sole thereof. One suitable form of socket is shown by way of example in FIG. 8. This form of socket is the subject of British patent application No. 1,564,983 published Apr. 16, 1980. Briefly the socket 21 is formed as a unitary moulding of a plastics material and comprises a body portion 22 which is open at the lower end and closed at the upper end and is internally screw-threaded to receive the sleeve 16 of a stud of the kind shown in FIG. 3. The socket also comprises retaining means in the form of outwardly directed fins 23 of tapered shape and a ring 24 linking together the outer end parts of the fins. The socket 21 is moulded into the sole of an article of footwear so that the lower end of the body portion 22 is flush with the underside of the sole, and the socket is firmly held in place by the material from which the sole is formed entering between the fins 23 and embracing the ring 24. It is to be understood, however, that the studs may equally well be used with other types of sockets such as metal sockets of conventional form.

When the stud is being installed the sleeve 16 is screwed into the socket and the outer part of the concave surface of the flange 17 abuts the sole while the inner part of that surface abuts the lower end of the socket. The holes 19 are intended for co-operation with a spanner-like tool (not shown) provided with a pair of driving pegs capable of entering either pair of diametrically opposed holes and by means of which the stud can be screwed into the socket or removed from it. In a modified form of support, illustrated in FIG. 5, the flange 25 is no longer of entirely circular shape but is formed with two parallel flats 26 to enable it to be engaged and rotated by a spanner-like tool having spaced jaws. The holes 19 are omitted in this modification. In another modification, not illustrated, the flange is of hexagonal shape.

As the support is made from a plastics material it cannot corrode or rust and cannot therefore become permanently bound in the associated socket as sometimes tends to occur when an all-metal stud is used. When the article of footwear is in use considerable strain in applied to the stud. Nevertheless in normal use the pin element will not become separated from the support when external forces, due to contact with the ground, act on the head of the element. These forces are transferred to the support, and the plastics material as a whole will tend to yield. This yielding of the support helps to distribute the forces and prevent wear and damage to the socket and to the article of footwear. If a stud becomes worn and is to be replaced the stud can simply be unscrewed, using the spanner-like tool, and a fresh stud can be screwed in.

When a stud is screwed fully into its associated socket as described above the outer part of the flange abuts the sole while the inner part of the flange abuts the socket. If the socket is slightly recessed in the sole then, of course, the flange will not be able to abut the socket. Likewise if the length of the hole in the socket is slightly less than the length of the sleeve and riveted part 20 the upper end of the stud will engage the closed upper end of the socket (or may engage the sole itself when the socket is open-topped) thereby preventing the flange abutting the socket. In each instance, however the stud is screwed tightly into place to prevent it becoming unscrewed in use. Further, the arrangement is preferably such that when the stud is fully screwed into place the flange of the support is resiliently deformed so that the extent to which it is domed is reduced or the flange becomes substantially planar. The advantage of that arrangement is that when the article of footwear is in use and the sole bends the resilience of the flange of the support enables the outer edge part of the flange to remain in contact with the sole, thereby preventing the ingress of material such as gravel or earth between the flange and the sole.

In order to ensure a satisfactory seal between the outer part of the flange and the sole when the article of footwear is in normal use, the modification illustrated in FIG. 6 may be adopted. In this modification the flange 26 is formed so that its outer marginal part is tapered to provide an annular rim 27 directed axially of the stud and for engagement with the underside of the sole. The rim 27 may press into the sole a short way so as to form an effective seal. FIG. 6 also illustrates another, minor, modification: the blind holes 19 are here replaced by the through holes 28. A modified form of rim is illustrated in FIG. 7. Here the flange 29 has a tapered rim 30 constituting the outer marginal part of the flange. The rim 30 is directed outwardly rather than axially and in use it does not tend to press into the sole but yields resiliently to form a lip seal.

Although each of the embodiments described includes a unitary support, the support may be made of two or more pieces. In particular the sleeve may be formed separately from the flange. The pieces may be welded together or secured together adhesively. Alternatively they may be merely located together on the pin element. Whatever arrangement is adopted it is of course essential to provide means enabling the sleeve to be positively screwed into an associated socket.

Various modifications have been described above, and several of them are illustrated in the accompanying drawings. It is to be understood that a stud embodying the invention may include any one or more of these modifications as desired and as appropriate.

I claim:

1. A method of making a stud for footwear, the stud comprising a support made of plastics material and a metal pin element, the support comprising an externally screw-threaded sleeve, for engagement with an internally screw-threaded socket in an article of footwear, and an outwardly directed flange for engagement with the lower end of the socket or with the underside of the article of footwear, and the pin element comprising a stem and a ground-engaging head, and the method comprising the steps of inserting the stem into the sleeve of the support and deforming the stem after insertion to secure the support and the pin element permanently together prior to engagement of said support with said internally screw-threaded socket.

2. A method according to claim 1 in which a portion of the stem is deformed after insertion so as to cause the support to be securely retained between said deformed portion and an abutment surface on the head of the pin element.

3. A method according to claim 2 in which said portion is constituted by that end portion of the stem further from the head, and in which said portion is provided with an axial opening, said portion being riveted over to form a securing flange after the stem has been inserted into the sleeve.

4. A stud for footwear comprising a support made of plastics material and a metal pin element, the support comprising an externally screw-threaded sleeve, for engagement with an internally screw-threaded socket in an article of footwear, and an outwardly directed flange for engagement with the lower end of the socket or with the underside of the article of footwear, and the pin element comprising a stem and a ground-engaging head, the stem having been deformed after insertion into the sleeve of the support to secure the support and the pin element permanently together to define a stud which may be subsequently engaged as a unit with said screw-threaded socket.

5. A stud according to claim 4 in which that end portion of the stem further from the head has been riveted over to form a securing flange.

6. A stud according to claim 5 in which the riveted end portion is formed wth an axially extending hollow.

7. A stud according to claim 4 in which the flange of the support is in the shape of a shallow dome, the sleeve projecting from the concave side thereof.

8. A stud according to claim 4 in which the outer marginal part of the flange of the support is tapered to provide an annular rim for engagement with the underside of the article of footwear.

9. A stud according to claim 4 in which the support is formed as a unitary moulding.

* * * * *